United States Patent [19]

Palumbo

[11] Patent Number: 4,727,459

[45] Date of Patent: Feb. 23, 1988

[54] GAS DISCHARGE ILLUMINATION DEVICE

[75] Inventor: Pacifico A. Palumbo, Forest Hills, N.Y.

[73] Assignee: Neon Modular Systems, Inc., New York, N.Y.

[21] Appl. No.: 882,080

[22] Filed: Jul. 3, 1986

[51] Int. Cl.[4] ..... F21K 1/00; G09F 13/26

[52] U.S. Cl. ..... 362/260; 362/222; 362/806; 362/812; 40/545; 313/567; 313/312

[58] Field of Search ..... 362/260, 32, 34, 222, 362/217, 806, 812; 313/484, 494, 312, 315, 567; 40/545

[56] References Cited

U.S. PATENT DOCUMENTS

| | | | |
|---|---|---|---|
| 1,826,385 | 10/1931 | Beck | 313/567 |
| 3,507,065 | 4/1970 | Fullerton | 40/545 |
| 3,808,495 | 4/1974 | Win | 313/312 X |
| 3,845,343 | 10/1974 | Hammer | 313/567 |
| 4,147,947 | 4/1979 | Hoeh | 313/312 X |

*Primary Examiner*—Larry Jones

*Attorney, Agent, or Firm*—Cohen, Pontani & Lieberman

[57] ABSTRACT

A noble gas illumination device such as a neon tube in which the glass neon tube is clear and uncoated and is surrounded by a clear plastic tube. The clear plastic tube may be tinted or colorless. If it is tinted, it alters the color of the light emanating from the device. Whether tinted or untinted, the clear plastic tube makes the uncoated neon tube appear to have a larger diameter, thereby creating the illusion that the electric discharge beam in the neon tube is extremely thin and focused and has the appearance of a laser beam.

14 Claims, 4 Drawing Figures

GAS DISCHARGE ILLUMINATION DEVICE

BRIEF SUMMARY OF THE INVENTION

This invention relates to gas discharge illumination devices including neon or argon tubes or the like and especially to such a device that is constructed to yield an illuminated beam that simulates a laser beam. The device incorporates a transparent noble gas tube with no interior wall coating, which neon tube is surrounded by a clear plastic tube that makes the apparent diameter of the noble gas tube significantly greater than a conventional neon tube. Such a device creates the illusion of a very thin ray-like beam inside of the device which beam gives the appearance of a laser beam. The surrounding plastic tube also makes the device substantially less fragile and, if the transparent plastic tube is tinted, it can alter the perceived color of the gas discharge beam to provide a mechanism by which a wide variety of colors may be produced.

THE PRIOR ART

Electric gas discharge tubes, commonly referred to as neon tubes, are well known in the art. Such devices may include a glass tube that is clear or that is coated as with an electro-excitable material such as a phosphor. When the tube is uncoated, then the electric discharge beam through the tube appears relatively thin as compared with the outer diameter of the glass tube of the discharge device whereas when the tube is coated, as that term is subsequently defined herein, the illumination seems to fill the entire tube and be of the same diameter as the tube.

It has also been known heretofore to encase electric gas discharge tubes in a clear plastic cover for the purpose of protecting the fragile glass tube of the neon sign. Such envelopment of electric gas discharge tubes may be seen for example in U.S. Pat. No. 2,214,447 issued to E. B. Bave on Sept. 10, 1940 for Lighting System for Automobiles, U.S. Pat. No. 3,968,359 issued to Richard Shaffer on July 6, 1976 for Fluorescent Lamp, and U.S. Pat. No. 4,413,311 issued to Philip Orenstein on Nov. 1, 1983 for Connection System for Joining Illuminated Modules. Other patents that disclose similar structures are U.S. Pat. Nos. 3,599,911 and 3,569,689.

DETAILED DESCRIPTION OF THE PREFERRED EMBODIMENT

Figure 2:
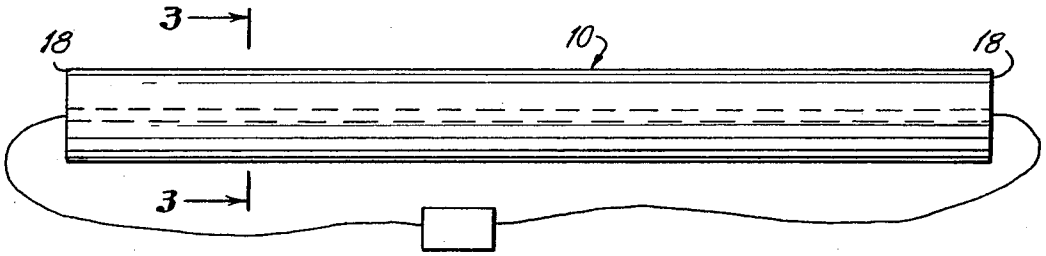
FIG. 2 is a side elevational view of the preferred form of my illumination device.
Figure 4:
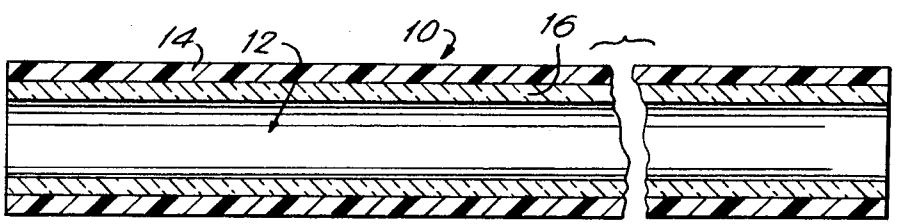
FIG. 4 is a longitudinal sectional view of the illumination device of the present invention, taken along the line IV—IV of FIG. 3.
Figure 3:
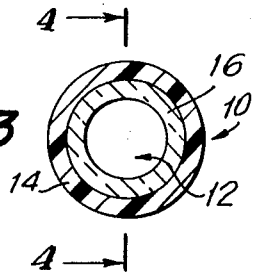
FIG. 3 is a transverse sectional view of the illumination device of FIG. 2 taken along the line III—III in FIG. 2.

Referring first to FIGS. 2, 3 and 4, an illumination device 10 is illustrated, which device as shown and as presently preferred is elongated and straight, although the device may be shaped into curves or the like if desired. The device 10 includes a gas discharge device 12 surrounded by a clear or transparent plastic tube 14.

As best seen in FIGS. 3 and 4, it is presently preferred that the tube 14 fit snugly but with slight clearance around the tube 16 of device 12, although greater clearance could be employed without departing from the invention.

The gas discharge device 12 is preferably a noble gas discharge device in which a transparent glass tube 16 is first substantially evacuated and then filled with a noble gas such as neon, argon or krypton or the like and sealed at the ends by electrode structures 18 which may be of any design. The glass tube 16 may also contain within it various metals, metal compounds or metal vapors for the purpose of altering the color of the electrical discharge, as is well known in the art. The transparent glass tube 16, either colorless or tinted, includes a wall which is uncoated. As used herein, the term "uncoated" means that there is nothing on the wall of the tube 16 to alter the propagation of light generated by a standard electrical discharge through the gas discharge device 12. Thus, for example, there is no phosphor or other electro-excitable material on the inner wall of tube 16 nor is the tube otherwise treated to alter the appearance of the light as, for instance, by roughening a surface to make the tube translucent or to scatter the light generated by the electric gas discharge. Tube 16 is, as already stated, transparent so that one viewing the light emanating from device 10 sees the light beam unaltered as by florescence or diffusion or the like. Such a gas discharge tube creates a narrow beam of light as compared with the light generated by a gas discharge tube in which the wall is coated, as that term is used herein.

In accordance with the present invention, the transparent plastic tube 14 is in surrounding relation with the glass tube 16 of the gas discharge device 12, preferably in close surrounding relation therewith, for the purpose of creating the illusion of a significantly greater diameter gas discharge device 12 than actually exists in device 10, whereby to make the narrow beam 19 appear to be even more narrow and focused, like a laser. The clear plastic tube 14 can be made out of any clear plastic material such as, for example, a transparent acrylic, styrene, polycarbonate or any other suitable transparent plastic. It is presently preferred to employ a transparent acrylic such as, for example, polymethylmethacrylate.

In accordance with another feature of the present invention, the transparent plastic tube 14 may be tinted whereby to alter the observed color of the illumination emanating from the device 10. If so tinted, the device 10 can be built to create a very wide variety of different colors, far greater than is obtainable by just relying on the choice of noble gas and/or metal vapor. Irrespective of whether or not the plastic tube 14 is colorless or tinted, in addition to providing protection for the fragile glass tube 16, the clear plastic tube 14 creates the illusion of constituting the outer diameter of the gas discharge device 12, rather than the outer wall of the tube 16. This illusion makes the electric discharge through gas discharge device 12 appear to be much thinner than is normally encountered in neon tubes and the like since the relative diameter of the electric discharge beam when compared with the outer diameter of the plastic tube 14 is very thin. Thus the device 10 as an entity creates an illusion of a sharp concentrated light beam, sometime with a pale aura surrounding it, like a laser, which, to the best of the inventor's knowledge has never before been achieved. Therefore, a single tube may be employed as to simulate a stick of light or a light pipe or the like.

The power supply for device 10 is shown by the reference numeral 20 and may be of any suitable form. Power from the power supply 20 is supplied to the illumination device 10 through terminals 18 which may be constructed in any suitable manner, although it is generally preferred that the terminals 18 be of such a construction as to enable them to be confined within the interior of the plastic tube 14.

Figure 1:
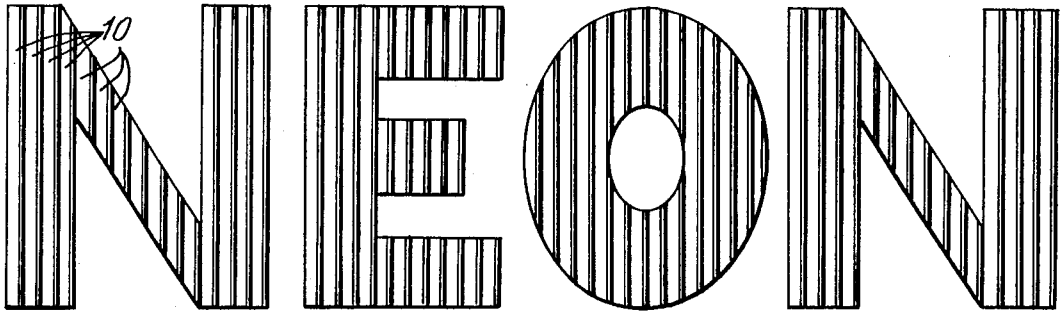
FIG. 1 is a front elevational view of a sign made up of a multiplicity of illumination devices embodying the present invention.

Depending on the nature of the power supply 20, an array of illumination devices 10 of the type hereinbefore described may be connected in series, in parallel, in parallel-series or in series-parallel to form some kind of intelligible display. Thus, for example, and as shown in FIG. 1, a multiplicity of tubes 10 of different lengths can be arranged to spell out a word, here shown by way of example and not by way of limitation, as the word "NEON". Clearly, pictures, designs and the like can also be formed. It will be seen from FIG. 1 that in this exemplary use of this invention the tubes are all physically (but not necessarily electrically) arranged in parallel and yield a striped visual effect of high intensity because of the apparent narrowness of the electric discharge beam in each of the separate devices 10. Clearly the array of devices 10 in the sign 22 can be arranged electrically, depending on the nature of the power supply 20, in series, in parallel, in parallel groupings of series connected tubes or in series-parallel.

While I have herein shown and described the preferred form of this invention and have suggested modifications thereto, other changes and modifications may be made therein within the scope of the appended claims without departing from the spirit and scope of this invention.

What is claimed is:

1. An illumination device for producing light from an electric discharge through a gas filled tube, and discharge having the appearance of being thin and ray-like, like a gaseous laser discharge, said illumination device comprising an elongated gas filled electric discharge illumination tube having no coating on the wall thereof of the type that alters the nature of the light emitted therefrom so that the thickness of the discharge appears thinner than the inner diameter of said illumination tube, said illumination tube having terminals located at axially opposite ends of the tube, and a transparent plastic tube in surrounding relation with said illumination tube for increasing the apparent diameter of said illumination tube whereby to enchance the visual effect of the thinness of said illuminated gas discharge to thereby simulate with a gas discharge illumination device the appearance of a gaseous laser discharge.

2. The illumination device of claim 1, wherein the gas with which said illumination tube is filled is a noble gas.

3. The illumination device of claim 1, wherein said transparent plastic tube is substantially colorless.

4. The illumination device of claim 1, wherein said transparent plastic tube is tinted.

5. The illumination device of claim 4, wherein said transparent plastic tube is tinted for altering the perceived color of said illuminated gas discharge.

6. The illumination device of claim 1, wherein said illumination tube and said transparent plastic tube are both straight.

7. The illumination device of claim 2, wherein said transparent plastic tube is substantially colorless.

8. The illumination device of claim 2, wherein said transparent plastic tube is tinted.

9. The illumination device of claim 2, wherein said transparent plastic tube is tinted for altering the perceived color of said illuminated gas discharge.

10. The illumination device of claim 2, wherein said illumination tube and said transparent plastic tube are both straight.

11. The illumination device of claim 3, wherein said illumination tube and said transparent plastic tube are both straight.

12. The illumination device of claim 4, wherein said illumination tube and said transparent plastic tube are both straight.

13. The illumination device of claim 5, wherein said illumination tube and said transparent plastic tube are both straight.

14. An illumination display comprising a plurality of substantially parallel illumination devices as set forth in claim 10, said illumination devices being of such lengths and perceived color as to form an illuminated sign.

* * * * *

UNITED STATES PATENT AND TRADEMARK OFFICE

CERTIFICATE OF CORRECTION

PATENT NO. : 4,727,459

DATED : February 23, 1988

INVENTOR(S) : Pacifico A. Palumbo

It is certified that error appears in the above-identified patent and that said Letters Patent is hereby corrected as shown below:

Column 3, line 38, the word "and" should be --said--.

Signed and Sealed this

Ninth Day of August, 1988

*Attest:*

DONALD J. QUIGG

*Attesting Officer*

*Commissioner of Patents and Trademarks*